US010871275B2

(12) United States Patent
Gomez Martinez et al.

(10) Patent No.: US 10,871,275 B2
(45) Date of Patent: Dec. 22, 2020

(54) LIGHTING SYSTEM FAMILY WITH MODULAR PARTS AND STANDARDIZED EXTRUDED ELEMENTS

(71) Applicant: Nicor, Inc., Albuquerque, NM (US)

(72) Inventors: Jorge A. Gomez Martinez, Albuquerque, NM (US); David Brown, Rio Rancho, NM (US)

(73) Assignee: NICOR, INC., Albuquerque, NM (US)

( * ) Notice: Subject to any disclaimer, the term of this patent is extended or adjusted under 35 U.S.C. 154(b) by 0 days.

(21) Appl. No.: 16/407,014

(22) Filed: May 8, 2019

(65) Prior Publication Data

US 2019/0346116 A1 Nov. 14, 2019

Related U.S. Application Data

(60) Provisional application No. 62/668,619, filed on May 8, 2018.

(51) Int. Cl.

| | |
|---|---|
| ***F21V 29/00*** | (2015.01) |
| ***F21V 15/01*** | (2006.01) |
| ***F21V 29/74*** | (2015.01) |
| ***F21S 4/28*** | (2016.01) |
| ***F21V 23/00*** | (2015.01) |
| ***F21S 8/04*** | (2006.01) |
| *F21Y 103/10* | (2016.01) |
| *F21Y 115/10* | (2016.01) |

(52) U.S. Cl.

CPC ..... *F21V 15/013* (2013.01); *F21S 4/28* (2016.01); *F21S 8/043* (2013.01); *F21V 23/009* (2013.01); *F21V 29/74* (2015.01); *F21Y 2103/10* (2016.08); *F21Y 2115/10* (2016.08)

(58) Field of Classification Search

CPC ..... F21V 29/74; F21S 4/28; F21S 2/005

See application file for complete search history.

(56) References Cited

U.S. PATENT DOCUMENTS

| | | | | |
|---|---|---|---|---|
| 7,311,423 | B2 | 12/2007 | Frecska et al. | |
| 7,476,004 | B2 | 1/2009 | Chan | |
| 2005/0190553 | A1* | 9/2005 | Lynch | F21S 4/28 362/227 |
| 2010/0259927 | A1* | 10/2010 | Chien | F21S 2/005 362/235 |
| 2012/0113628 | A1 | 5/2012 | Burrow et al. | |
| 2012/0250309 | A1 | 10/2012 | Handsaker | |
| 2012/0320627 | A1 | 12/2012 | Araki et al. | |
| 2013/0027935 | A1* | 1/2013 | Ladewig | F21S 2/00 362/249.01 |
| 2015/0016100 | A1 | 1/2015 | Ishii | |

(Continued)

*Primary Examiner* — Matthew J. Peerce

(74) *Attorney, Agent, or Firm* — Loza & Loza LLP; Kevin L. Soules

(57) ABSTRACT

A family of lighting systems uses a small number of standard parts or extrusions. The extrusions include end elements, spars, and heat sinks. Lightbars and uplights, having heat sinks, LED arrays, and lenses, use heat sinks with the same extrusion profile. The extruded parts can be slid together and then held in place by screws holding side panels to form a housing. Conditioned electrical power can drive the LED arrays. The conditioned power can be produced by power conditioners mounting on the housing. IP65, or better, components can be used to produce a rugged outdoor system.

20 Claims, 11 Drawing Sheets

(56) References Cited

U.S. PATENT DOCUMENTS

| | | | | |
|---|---|---|---|---|
| 2015/0085487 | A1* | 3/2015 | Yun | F21V 31/03<br>362/249.01 |
| 2015/0300610 | A1* | 10/2015 | DeCarr | F21S 8/061<br>362/249.07 |

* cited by examiner

LIGHTING SYSTEM FAMILY WITH MODULAR PARTS AND STANDARDIZED EXTRUDED ELEMENTS

CROSS REFERENCE TO RELATED PATENT APPLICATIONS

This patent application claims the priority and benefit under 35 U.S.C. § 119(e) of U.S. Provisional Patent Application Ser. No. 62/668,619 filed May 8, 2018, entitled "LIGHTING SYSTEM FAMILY WITH MODULAR PARTS AND STANDARDIZED EXTRUDED ELEMENTS." U.S. Provisional Patent Application Ser. No. 62/668,619 is herein incorporated by reference in its entirety.

TECHNICAL FIELD

Embodiments are generally related to LED lighting, lighting fixtures, and LED lighting power supplies.

BACKGROUND

Lighting systems have been evolving at a rapid pace with moves from incandescent, fluorescent, and gas discharge to light emitting diodes (LEDs). LEDs have been improving in efficiency, thermal management, and cost. Similarly, the power supplies, a.k.a. drivers, which drive the LEDs have seen improvements in efficiency, thermal management and cost. In general, residential and commercial lighting is transitioning to the use of LED lighting technologies.

U.S. Pat. No. 7,311,423 by Frecska et al. issued on Dec. 25, 2007 and is titled "Adjustable LED Luminaire." Frecska teaches a luminaire having multiple movable LED strips in a large fixture. It is for its teachings of LED arrays, electronics, drivers, and fixtures that U.S. Pat. No. 7,311,423 is herein incorporated by reference in its entirety.

U.S. Pat. No. 7,476,004 by Chan issued on Jan. 13, 2009 and is titled "LED Lighting Lamp Tube." Chan teaches LED arrays mounted in tubes and configured to replace fluorescent light tubes in fluorescent fixtures. Replacements such as Chan's have provided an early upgrade path for commercial lighting in the move from fluorescent to LED. It is for its teachings of LED arrays, electronics, drivers, and fixtures that U.S. Pat. No. 7,476,004 is herein incorporated by reference in its entirety.

U.S. patent application Ser. No. 13/383,917 by Burrow et al. published as US 20120113628 on May 10, 2012 and is titled "Light Emitting Diode Retrofit Conversion Kit for a Fluorescent Light Fixture." Burrow also teaches LED arrays configured to replace fluorescent light tubes in fluorescent fixtures. Replacements such as Burrow's have provided an early upgrade path for commercial lighting in the move from fluorescent to LED. It is for its teaching s of LED arrays, electronics, drivers, and fixtures that US 20120113628 is herein incorporated by reference in its entirety.

U.S. patent application Ser. No. 13/075,494 by Handsaker published as US 20120250309 on Oct. 4, 2012 and is titled "LED Lighting Fixture With Reconfigurable Light Distribution Pattern." Handsaker teaches modular LED arrays with reconfigurable lenses and a fixture with an extruded aluminum base. It is for its teachings of LED arrays, electronics, drivers, and fixtures that US 20120250309 is herein incorporated by reference in its entirety.

U.S. patent application Ser. No. 13/473,929 by Araki, et al. published as US 20120320627 on Dec. 20, 2012 and is titled "Flat Panel Lighting Device and Driving Circuitry."

Araki teaches modular LED arrays and drivers configured in a relatively thin flat frame that can be edge lit. It is for its teachings of LED arrays, electronics, drivers, and fixtures that US 20120320627 is herein incorporated by reference in its entirety.

U.S. patent application Ser. No. 14/210,991 by Ishii published as US 20150016100 on Jan. 15, 2015 and is titled "Luminaire." Ishii teaches a fixture having an LED array and drivers with a long lens covering the electronic components. It is for its teachings of LED arrays, electronics, drivers, and fixtures that US 20150016100 is herein incorporated by reference in its entirety.

As can be inferred by this background section, the prior art discloses luminaires that can be used commercially, but that the overall packaging, fixtures, drivers, interconnects, and designs are still evolving. Systems and methods that provide commercial LED lighting with advanced packaging, fixtures, drivers, interconnects, and designs are needed.

BRIEF SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is an aspect of the embodiments that, in general, a modular lighting system has a housing and a light engine. For clarity in orientation, the lighting system has a top and a bottom. Typically being mounted to or near a ceiling, the bottom is that part through which the systems light bars emit LED light. The top either emits no light or provides a relatively small amount of light using one or more uplights. The system's spars, end elements, and heat sinks can be formed using an extrusion process. Every spar can have the same profile as every other spar. Every end element can have the same profile as every other end element. Every heat sink element can have the same profile as every other heat sink element. Using a small number of extrusion profiles provides for production savings. The extrusion profiles are complex, but once designed, cost about the same to extrude as simple profiles. The extruded elements have interlocking features such that they can slide together to form a structure and the parts held in place by side panels and fasteners.

The spar's extrusion profile can be designed such that every spar has two top slots, two bottom slots, a top channel, a bottom channel, two screw engagers, and a cross. The cross has an upright and a crossbeam. The screw engagers can be positioned at the ends on the ends of the cross beam. Fasteners passing through holes in the side panels can be threaded into the screw engagers to fasten the spars and side panels together. The top slots are positioned at one end of the upright, the first upright end, while the bottom slots are positioned on the upright's other end, the second upright end. The spar can have a top channel between the top slots and a bottom channel between the bottom slots.

The housing has two end elements running parallel to the spars and forming the outside ends of the housing. The end element's profile can be designed such that the end elements have a floor, a roof, a wall, a roof slot, a floor slot, a roof T-channel, a floor T-channel, a plurality of screw grooves, two support ribs, and a support channel. Fasteners passing through holes in the side panels can be threaded into the screw grooves to fasten the spars and end elements together.

Heat sink elements can be considered both structural, forming part of the housing, and part of the light engine. The disclosed embodiments, however, can have a rigid housing formed from spars, end elements, side panels, and screws. As such, the heat sinks are here more closely associated with the light engine. The heat sink's extrusion profile can be designed such that every heat sink element has a finned side, a flat side, a heat sink screw groove, and two slot engagements. The slot engagements are configured to slot into (i.e. slide into) the top slots and bottom slots of the spars and into the roof slots and floor slots of the end elements.

The light engine has a number of light bars and, optionally, one or more uplights. Each light bar and uplight has one or more LED assembly attached to a heat sink. The LED assemblies can have an LED array, a lens, and often a gasket. The LED assemblies can be mounted to the flat sides of heat sink elements. The lens can be attached to the heat sink element with the gasket forming a seal between heat sink element and lens. The LED array is positioned in the space between the heat sink element and the lens. The lens can be shaped to hold the LED array against the heat sink element or the LED array can itself be attached to the heat sink element.

Light bars typically have two LED assemblies mounted to the flat side of a light bar heat sink. Uplight panels (a.k.a uplights) typically have single LED assembly attached to an uplight heat sink. The light bar heat sink and uplight heat sink are heat sink elements with the same extrusion profile. In light bars, the LED assembly's lens, LED array, and gasket can be called a light bar lens, light bar LED array, and light bar gasket, respectively. In uplights, the LED assembly's lens, LED array, and gasket can be called an uplight lens, uplight LED array, and uplight gasket, respectively.

The lighting system can receive conditioned electric power that can directly power the LED arrays. Otherwise, the lighting system must condition whatever electric power is provided. The unconditioned power can be passed to power conditioners that can be attached to the end elements and covered by power housings. The power conditioners can provide conditioned electric power to the LED arrays. The power housings can be attached directly to the end elements by, for example, sliding bolts into the T-channel and attaching the power cover using screws threaded into the bolts.

An exemplary lighting system can have eight light bars and two uplights. The light bars can be arranged in a 4×2 pattern—four columns, two rows. The uplights positioned on the top side of the housing. A few, perhaps three, power conditioners can provide conditioned electric power to all the LED arrays or a larger number of smaller power conditioners can be used. For example, each light bar can be driven by its own power conditioner such that each light bar can be individually controlled by switching the power conditioners off and on or directing them to provide to provide a specified drive current.

The eight light bar system necessarily has two end elements, a first end element and a second end element, because all such systems have two end elements. The system has three spars between and holding together the light bar columns. As with all such lighting systems the eight bar system has two side panels helping hold the rest of the parts together. The slot engagements of the heat sink elements are slotted, as appropriate, into the spars top/bottom slots and into the end element's roof/floor slots.

Another exemplary lighting system assembled from substantially the exact same bill of materials is a three bar system having three light bars in one row. As before, the system has two end elements and two side panels. Here, only two spars are needed. The spars and end elements are about half as long as for an embodiment having two rows of light bars because both embodiments can use the same light bars.

A cover, with appropriate openings for the uplights, can be attached to the top of the housing. Some embodiments have the cover screwed to the top channels of the spars. Other embodiments simply slide sheets of material into the top slots of the spars and roof slots of the end elements such that the housing is completely covered.

It is another aspect of the embodiments to use "IP rated" (IP—Ingress Protected) components such as an IP65 junction box and similarly rated connectors passing electric power into the light bars and uplights. Those practiced in ruggedized components are aware of the various IP ratings. The disclosed embodiments can be assembled in an IP rate form using correctly rated electric cabling, junction boxes, and connectors. The gaskets between the lenses and heat sinks provide IP rated enclosures for the LED arrays. The housing itself has gaps and holes such that water entering the housing can drain from the housing. As such, the lighting system achieves an IP rating by using IP rated internal components instead of a sealed housing.

The aforementioned junction box can be mounted on a support bracket attached to a spar and an end element.

A lens frame attached to the bottom of the lighting system can hold a large bottom lens such as a diffusing lens. The bottom lens can be a sheet of translucent, dispersive, or textured material. The lens housing can be attached to the first and second ends by fasteners. For example, screws threaded into nuts that have been slid into the floor T-channels of the end elements.

Extrusions can be formed from aluminum. Extrusion is a process of shaping material by forcing it to flow through a shaped opening in a die. The extruded material, often called an extrusion, emerges as an elongated piece having a profile that is substantially identical to the profile of the die opening. The profile has width and height dimensions. The extrusion can be cut to a length, thereby determining the housing's length. The end caps are attached to the ends of the extrusion. The profile has features defining the extrusion's length running elements. As such, the length running elements are generally parallel to one another and run the complete length of the extrusion.

A light engine can include a power conditioner. A lighting system can receive electric power that is already conditioned for use by the LEDs or can receive unconditioned power, typically mains power (e.g. 120 VAC, 220 VAC, . . . ). A power conditioner conditions the electric power for use by the LEDs.

A wireway cover can cover a wireway opening in a component such as the power housing. Wireway covers can typically be easily removed and reinstalled to thereby cover and uncover a wireway opening. A wireway cover can simply cover the wireway opening and block access to the wireway. Alternatively, a wireway cover can have a knockout that can be pushed free of the wireway cover to produce a hole in the wireway cover. Wires can pass through the hole in the wireway cover and into the top opening and the wireway. A wireway cover can use an electrical connector for passing electric power or signals into the luminaire. An electric cable, such as a shielded cable or Ethernet cable can provide electric power and/or signals to the electrical connector, thereby powering and/or controlling the lighting system.

The electrical connector can be a panel feedthrough terminal block. For example, electrical power can be provided to the luminaire by an electric cable having at least two distinct conductors. Here, distinct conductor means insulated from one another such as an insulated wire and a bare wire or two insulated wires. In practice, the electric cable would have a power line, a return line, and possibly a ground line. The power line and return line are typically insulated wires while the ground line can be either a bare wire or an insulated wire. A 18/2 shielded cable is an example of an electric cable. The terminal block can be attached to a wireway cover or endcap and can be configured to pass electrical power from external wiring and into the internal wiring and circuitry of the luminaire. An 18/2 shielded cable is a shielded cable with two 18 gauge insulated wires and an internal shield covered by an outside insulator. An 18/4 shielded cable can carry electric power and control signals. The cable's shield or an additional wire can provide a ground connection. Electricians and those knowledgeable of electric wiring or the installation of electrical components are familiar with shielded cables and terminal blocks such as panel feed through terminal blocks.

Using an RJ45 socket as the electrical connector provides for using Ethernet cables to supply the luminaire with electric power or signals. Power Over Ethernet (POE) is a known set of standards for supplying power and signals to computer network equipment via Ethernet cables. An RJ45 socket has a row of eight connectors. A lighting system can be powered via POE or can be powered by simply running power with no signals into two or more of those connectors. For example, the power line can connect to the leftmost four connectors while the return line can connect to the rightmost four connectors. In such embodiments, an RJ45 power circuit that includes the RJ45 socket can be fixedly attached to the wireway cover while a hole in the wireway cover provides access to the RJ45 socket. Embodiments can pass power through an endcap by, for example, fixedly attaching the RJ45 power circuit to an endcap while a hole in the endcap provides access to the RJ45 socket.

A wireway cover can be attached to the power housing by one or more screws or other fasteners. A downward bend and tab arrangement can hold one end of the wireway cover in the wireway opening such that a single screw in the other end can fix the wireway cover in place.

It is yet another aspect of the embodiments that housings can have suspension brackets from which the housing can be suspended. The suspension brackets can be attached to the roof T-channels or floor T-channels of the end elements.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

DETAILED DESCRIPTION

Figure 1:
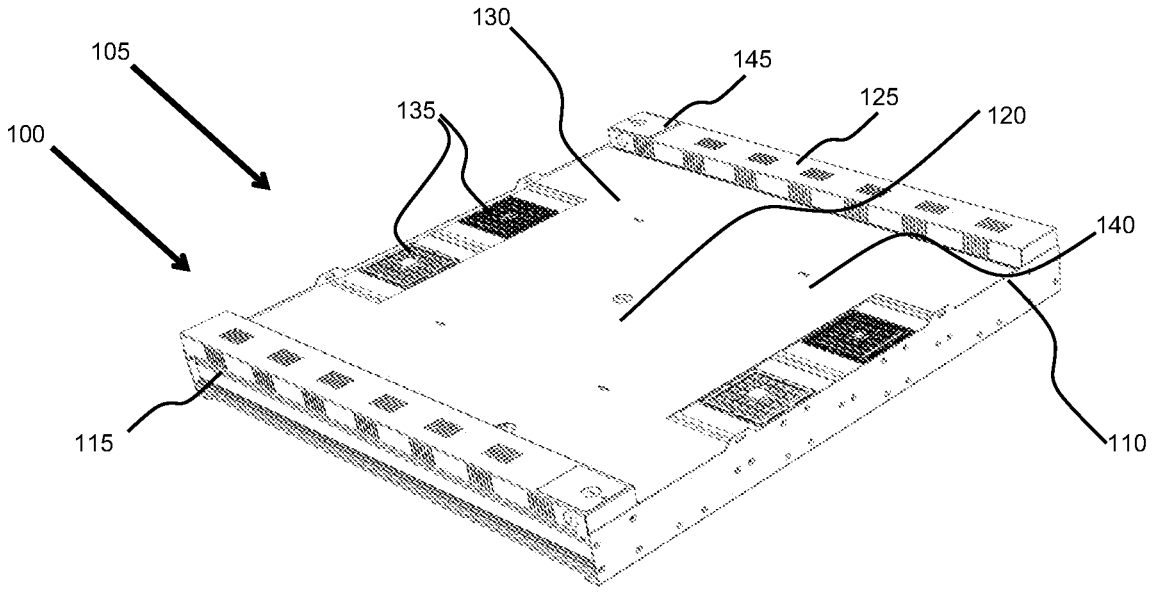
FIG. 1 illustrates an eight bar lighting system viewed from above in accordance with aspects of the embodiments.

The particular values and configurations discussed in these non-limiting examples can be varied and are cited merely to illustrate at least one embodiment and are not intended to limit the scope thereof.

For a general understanding of the present disclosure, reference is made to the drawings. In the drawings, like reference numerals have been used throughout to designate identical elements.

A family of lighting systems uses a small number of standard parts or extrusions. The extrusions include end elements, spars, and heat sinks. Lightbars and uplights, having heat sinks, LED arrays, and lenses, use heat sinks with the same extrusion profile. The extruded parts can be slid together and then held in place by screws holding side panels to form a housing. Conditioned electrical power can drive the LED arrays. The conditioned power can be produced by power conditioners mounting on the housing. IP65, or better, components can be used to produce a rugged outdoor system.

Figure 2:
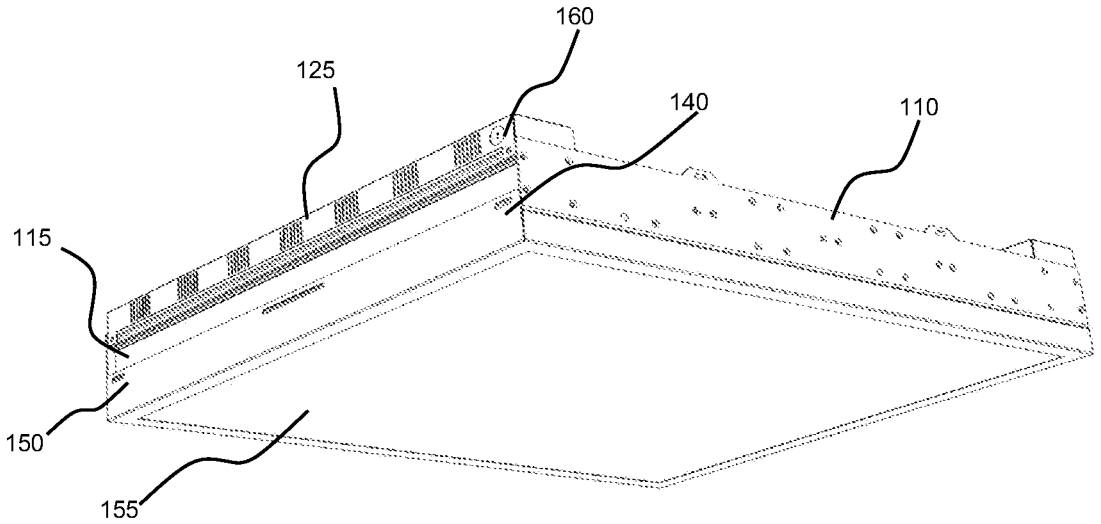
FIG. 2 illustrates an eight bar lighting system viewed from underneath in accordance with aspects of the embodiments.
Figure 3:
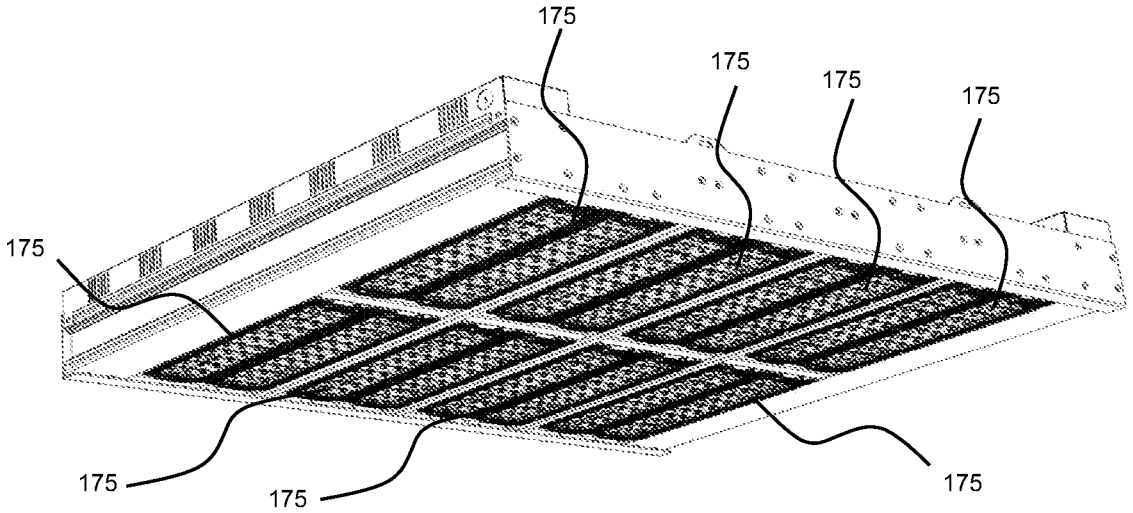
FIG. 3 illustrates an eight bar lighting system viewed from underneath and with the bottom lens and lens holder removed in accordance with aspects of the embodiments.

FIGS. 1-3 illustrate an eight bar lighting system 100 viewed from above, below, and with bottom lens removed. The housing 105 has side panels 110 screwed to end elements and internal spars. The cover 130 has openings for the uplights and two uplight panels 135. A wire hole 120 provides access to the interior of the lighting system for an electric cable. The electric cable is unlikely to be used because power conditioners under the power housings 125 can receive unconditioned electric power and provide power to the LED arrays. A knockout 160 is provided in the power housing 125. The lens holder is held to the end elements by fasteners inserted in a fastener hole such as screw/bolt pairs with the screw or bolt slid into a floor T-channel of an end element. The lighting system has two end elements called the first end and the second end. The light bars are arranged as two rows of four light bars. Each light bar has two LED arrays and two lenses. A wireway cover 145 can be provided. A lens frame 150 holds the lens 150. FIG. 3, illustrates a series of light bars 175 associated with the system 100.

Figure 4:
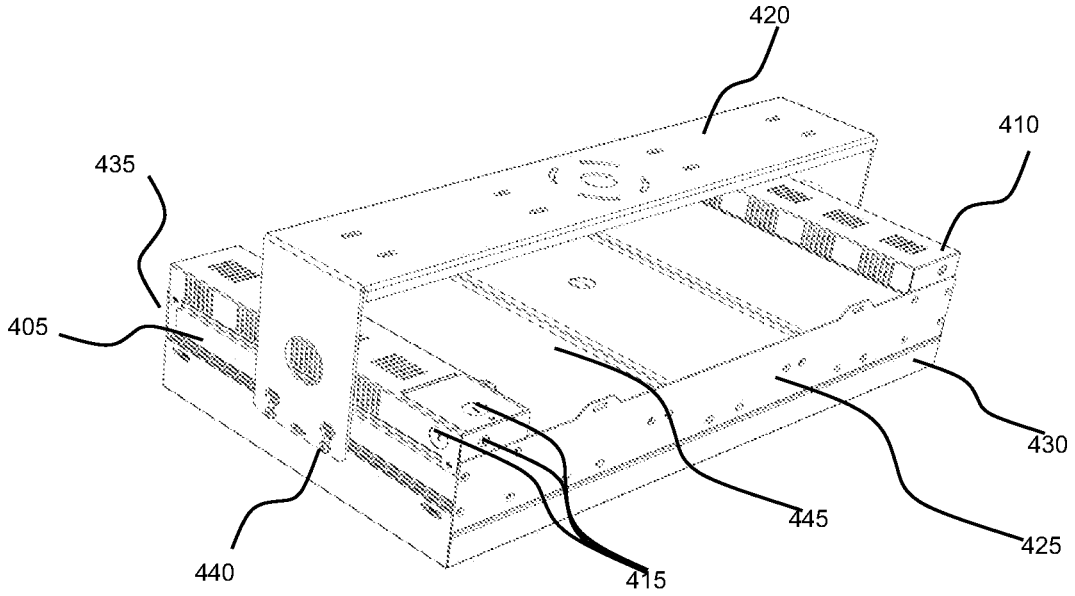
FIG. 4 illustrates a three bar lighting system viewed from above in accordance with aspects of the embodiments.
Figure 5:
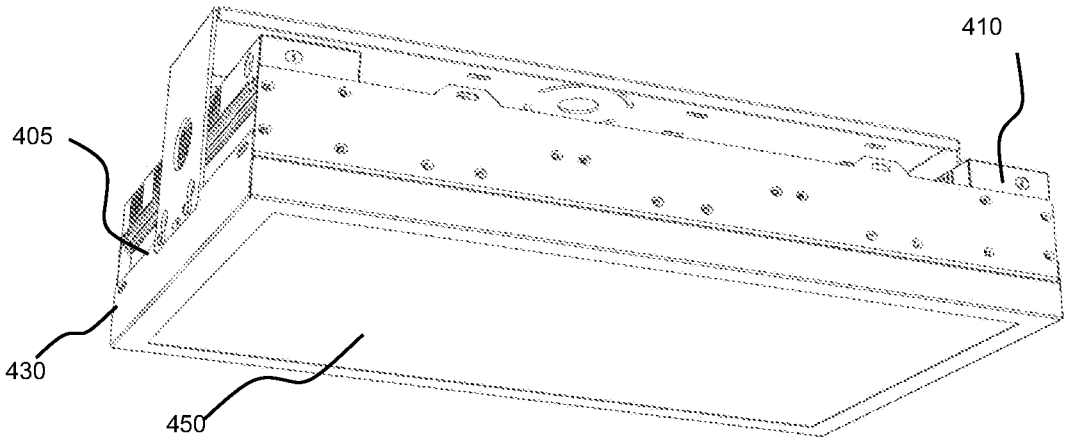
FIG. 5 illustrates a three bar lighting system viewed from underneath in accordance with aspects of the embodiments.
Figure 6:
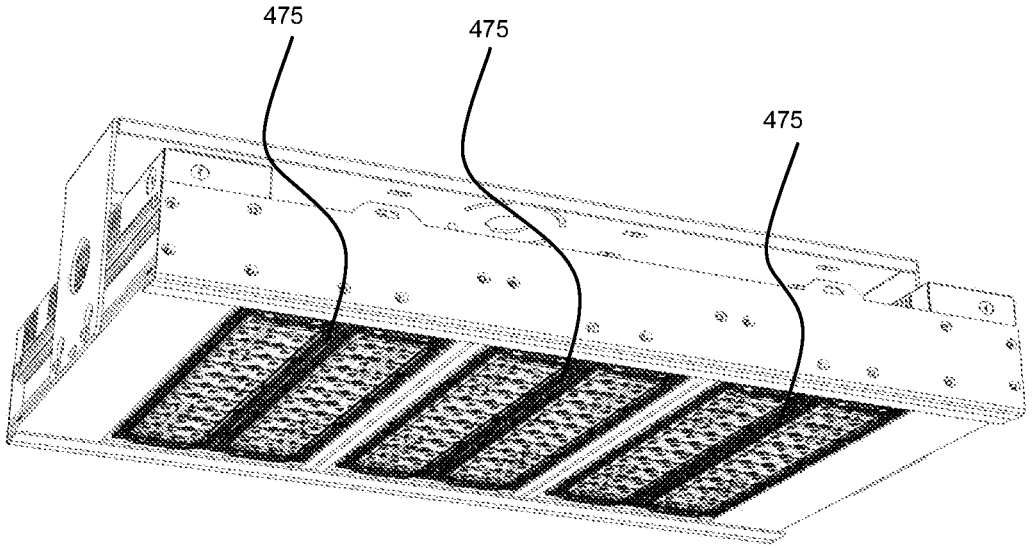
FIG. 6 illustrates a three bar lighting system viewed from underneath and with the bottom lens and lens holder removed in accordance with aspects of the embodiments.

FIGS. 4-6 illustrate a three bar lighting system 400 viewed from above, below, and with bottom lens removed. The six bar system is substantially similar to the eight bar system of FIGS. 1-3, including a side panel 425, lens frame 430 and lens 450, cover 445, fastener hole 435 for a screw or bolt in the T-channel, and screw 440 threaded into the bolt in the T-channel but has only three light bars arranged in a single row. The end elements 405, spars, and power housings 410 are about half as long as those in the eight bar embodiment. Unconditioned electric power can be passed into the power housings 410 by removing a knockout 415 and passing an electric cable through the hole. The unit can be deployed by hanging it from a suspension bracket 420 attached to the floor T-channels of the end elements. FIG. 6, illustrates a series of light bars 475 associated with the system 400.

Figure 7:
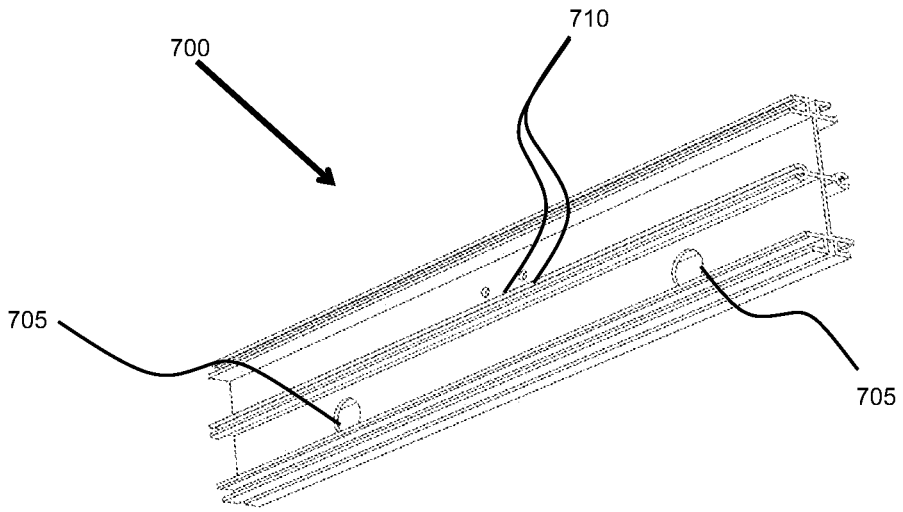
FIG. 7 illustrates a spar in accordance with aspects of the embodiments.
Figure 8:
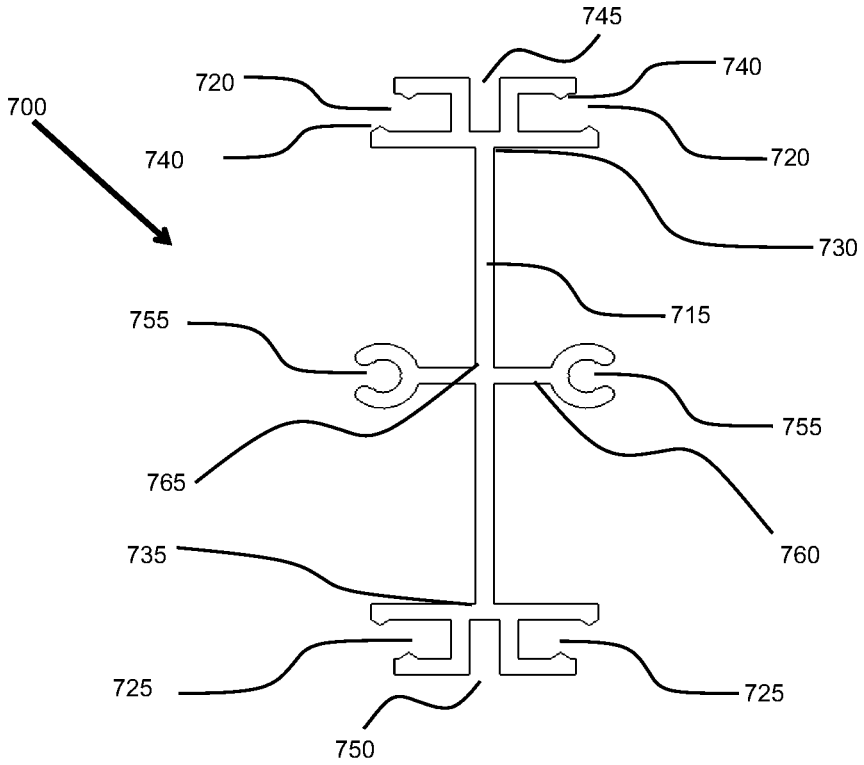
FIG. 8 illustrates a spar extrusion profile in accordance with aspects of the embodiments.

FIGS. 7 and 8 illustrate a spar 700 in accordance with aspects of the embodiments. The spar can include wireway holes 705 and fastener 710 for a support bracket. FIG. 8 illustrates the profile of all the spars 700 in the exemplary lighting systems. The illustrated spar 700 is left-right symmetrical and bottom-top symmetrical. The spar 700 has an upright 715 with two top slots 720 at a first end 730 of the upright and bottom slots 725 at the second end 735 of the upright. The top slots and bottom slots have slot ribs 740 that interface with slot grooves in the heat sink elements. A top channel 745 between the top slots can be used for attaching a cover to the housing. A bottom channel 750 between the bottom slots can also be used as an attachment point. Side panels can be attached to the spars by screws threaded into the screw engagers 755. The screw engagers can be positioned at either end of a cross beam 760, the cross beam and upright forming a cross 765.

Figure 9:
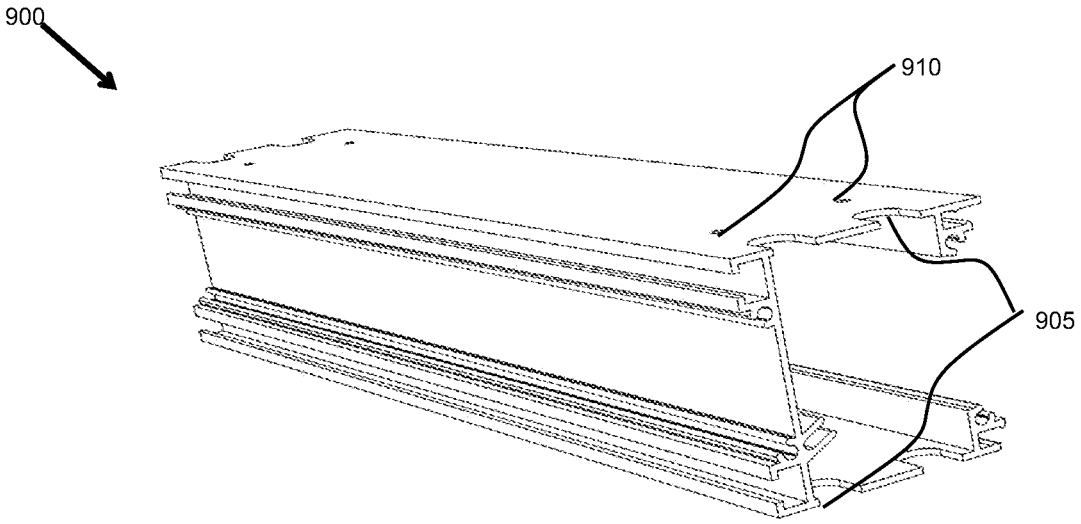
FIG. 9 illustrates an end element in accordance with aspects of the embodiments.
Figure 10:
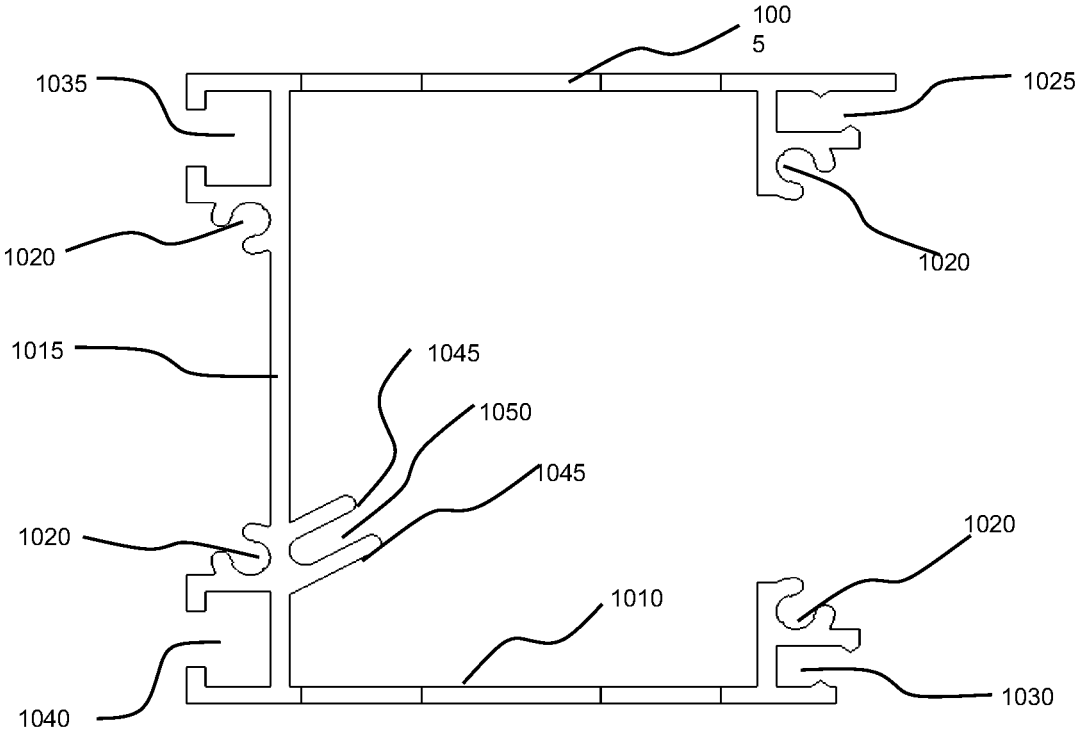
FIG. 10 illustrates an end element extrusion profile in accordance with aspects of the embodiments.
Figure 11:
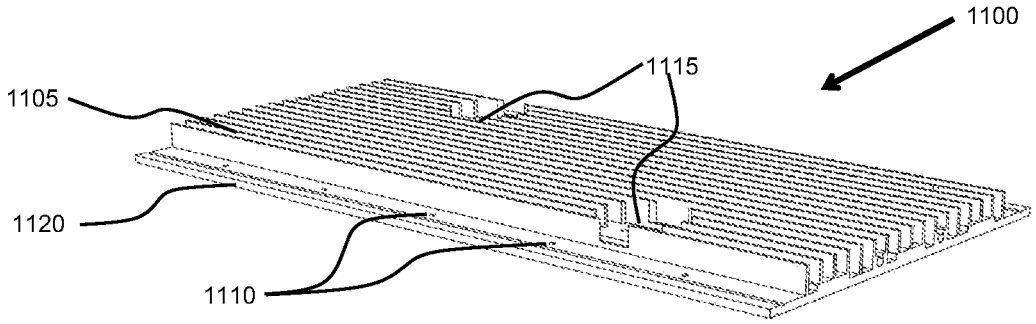
FIG. 11 illustrates a heat sink element viewed from above in accordance with aspects of the embodiments.
Figure 12:
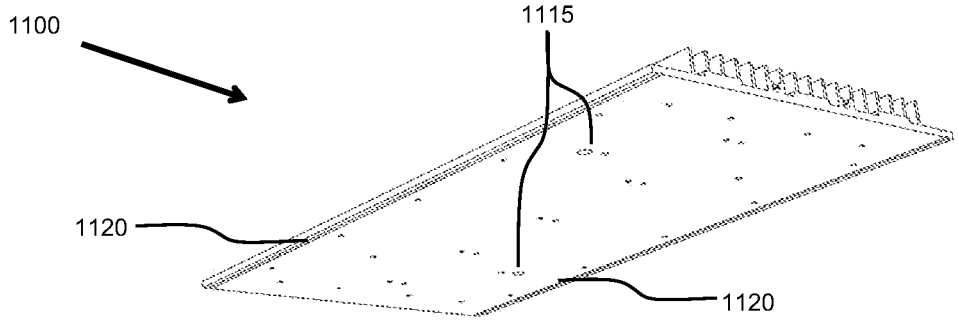
FIG. 12 illustrates a heat sink element viewed from underneath in accordance with aspects of the embodiments.
Figure 13:
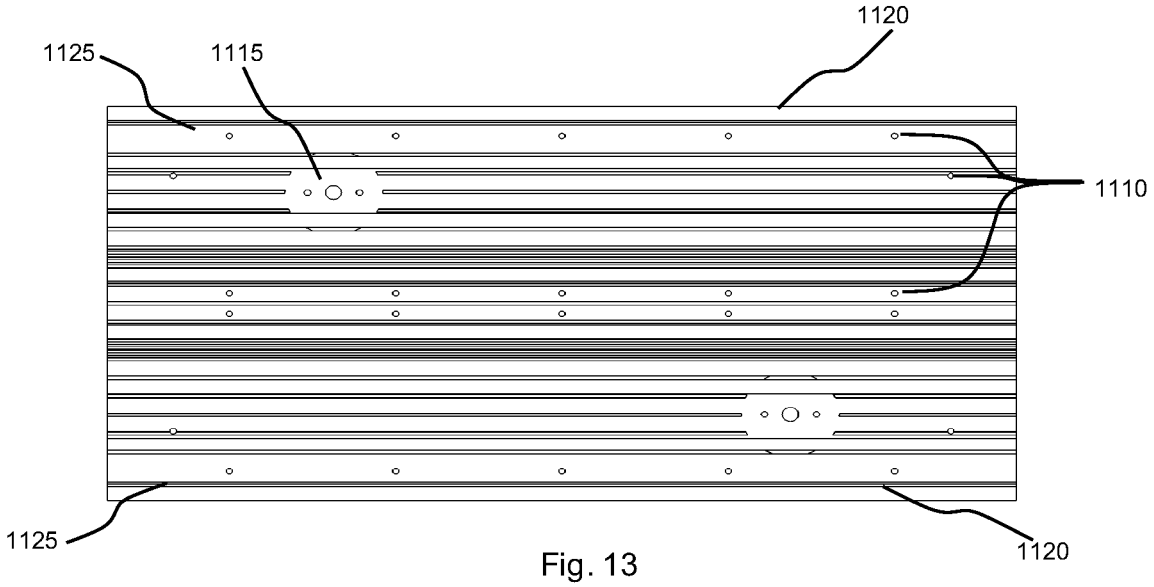
FIG. 13 illustrates a top view of a heat sink element in accordance with aspects of the embodiments.

FIGS. 9-10 illustrate an end element 900 in accordance with aspects of the embodiments. The end element comprises channels 905 for routing wires and power conditioner mounting holes 910. FIG. 10 illustrates the profile of all the end elements in the exemplary lighting systems. The end elements have a roof 1005, floor 1010, and wall 1015. Screws threaded into the screw grooves 1020 can attach side panels to the end elements. Roof T-channel 1035 and floor T-channel 1040 provide attachment points because fasteners such as bolts or the heads of screws can be slid into a T-channel and used for attaching components (e.g. suspension bracket, lens frame, power housing) to the end elements. Roof slot 1025 and floor slot 1030 are similar to the top/bottom slots of the spars in being configured to slidably interface with the heat sink elements. Support ribs 1045 and a support channel 1050 inside the end element can be used to attach an internal support bracket inside the housing.

Figure 14:
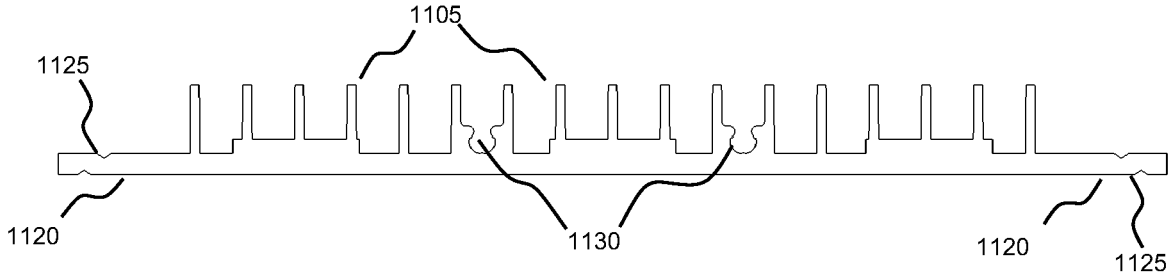
FIG. 14 illustrates a heat sink extrusion profile in accordance with aspects of the embodiments.

FIGS. 11-14 illustrate a heat sink element 1100 viewed from above in accordance with aspects of the embodiments. FIG. 14 illustrates the extrusion profile of all the heat sink elements in the exemplary embodiments. The heat sink elements include the light bar heat sinks and the uplight heat sinks. The heat sink elements have a finned side with numerous fins 1105 and a flat side. The LED assemblies can be attached to the flat side. Wire pass throughs 1115 and connector attachment point can be machined into the finned side of the heat sinks. Wires for powering the LED arrays can thereby pass through the holes. IP rated connectors or couplers can be attached on the fined side such that the power attachment is ingress protected. Holes for attaching lenses 1110 can be drilled in the heat sink elements. To preserve IP rating, the holes are outside the LED assembly gasketing. The heat sink elements have slot engagements 1120 that slidably interface with the top/bottom slots of the spars and the floor/roof slots of the end elements. The slot engagements have rib grooves 1125 that accommodate the slot ribs. Screw grooves 1130 can be provided on the finned side.

Figure 15:
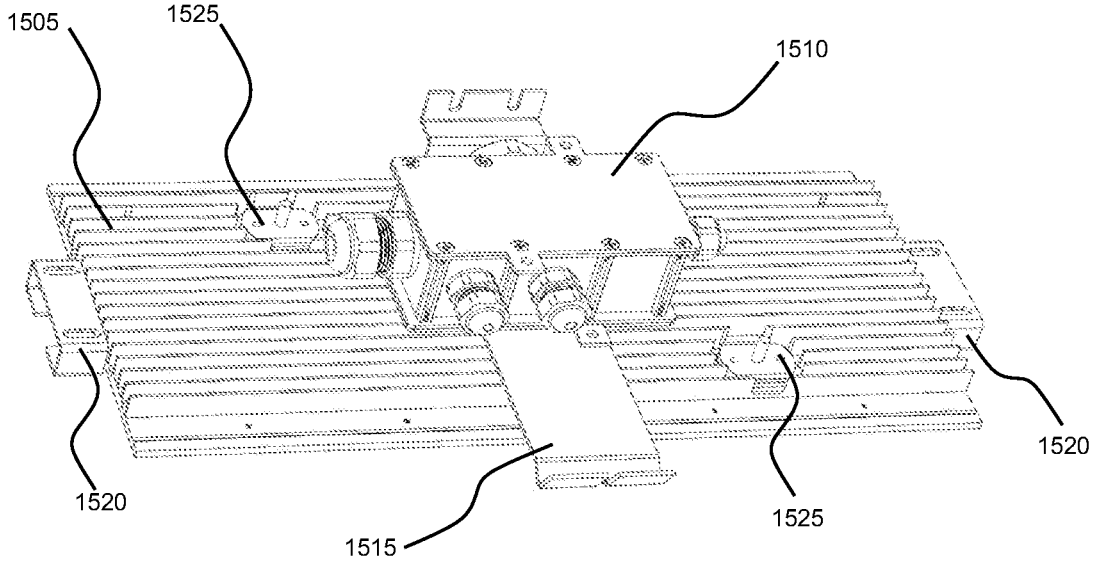
FIG. 15 illustrates a light bar and IP65 junction box in accordance with aspects of the embodiments.

FIG. 15 illustrates a light bar 1505 and IP65 junction box 1510 in accordance with aspects of the embodiments. The junction box 1510 is attached to a support bracket 1515. The support bracket can be attached to an end element and spar on either side of the light bar. The sides of the light bar can include a side spacer 1520, and includes passthrough connectors 1525.

Figure 16:
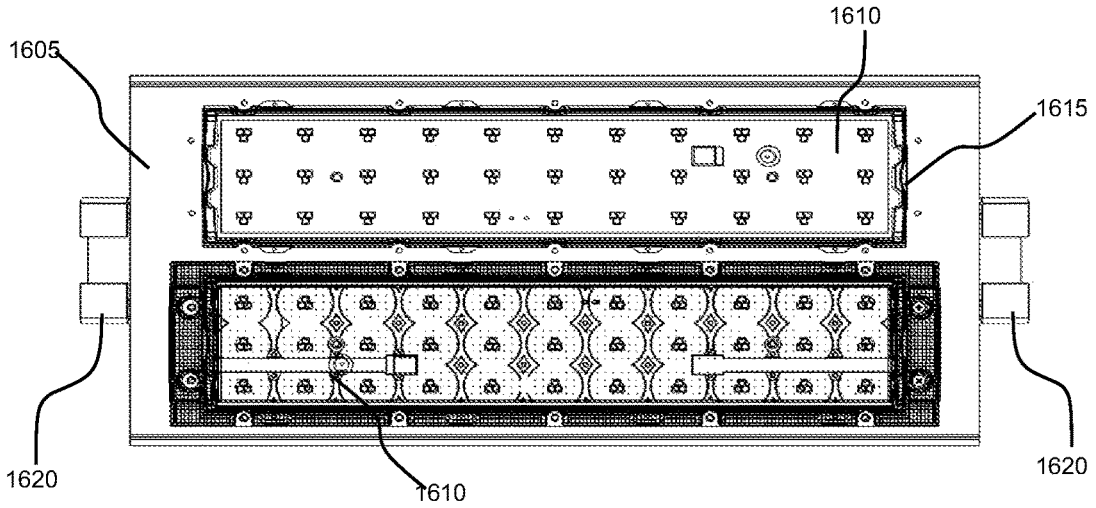
FIG. 16 illustrates a LED assembly on the flat side of a heat sink assembly in accordance with aspects of the embodiments.

FIG. 16 illustrates a LED assembly on the flat side of a heat sink assembly 1605 in accordance with aspects of the embodiments. Specifically, two heat sink assemblies are attached to a light bar heat sink and, for illustration, one of the lenses is removed. Each LED array 1610 is surrounded by a gasket 1615. A lens (here, light bar lens) attached over the LED array is sealed to the light bar heat sink by the gasket. Two side spacers 1620 are shown, one on either side of the light bar. The spacers can be formed from a rubbery material and provide cushioning and gap filling between the light bar and the side panel.

Figure 17:
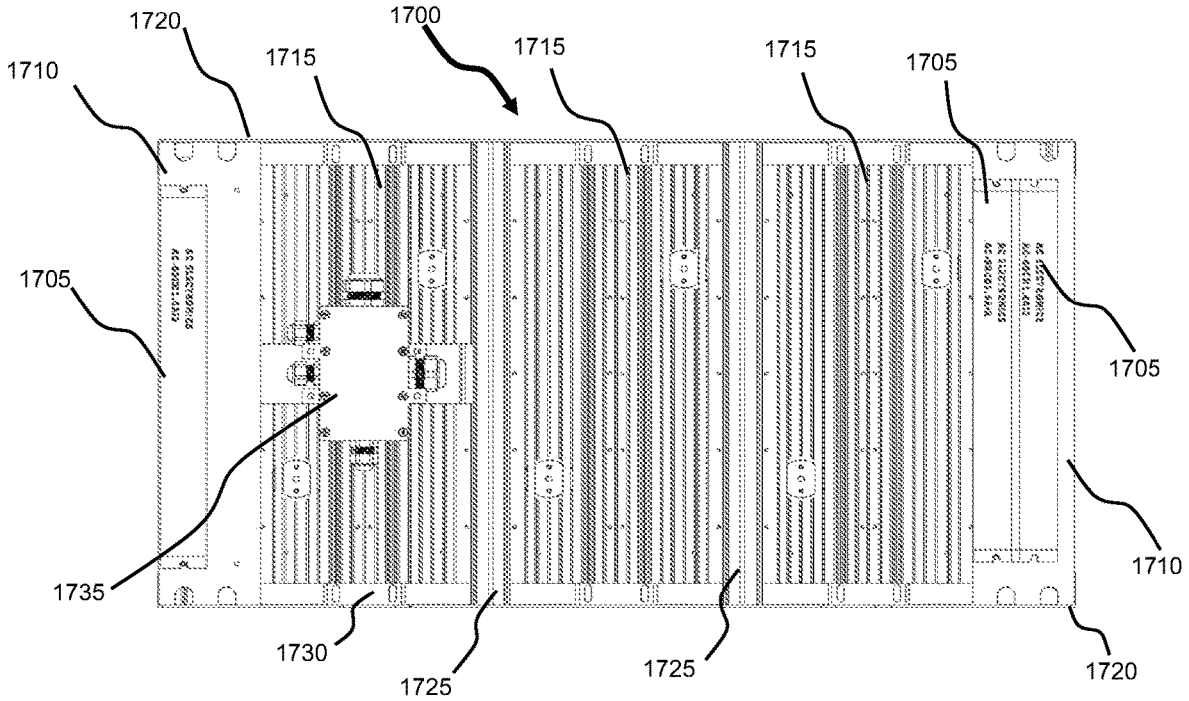
FIG. 17 illustrates a top view of a three bar lighting system with cover and power housings removed in accordance with aspects of the embodiments.

FIG. 17 illustrates a top view of a three bar lighting system 1700 with cover and power housings removed, but junction box 1735 visible, in accordance with aspects of the embodiments. Three power conditioners 1705 attached to the end elements 1710 are providing conditioned power to the three light bars 1715. The housing is completed by side panels 1720 screwed to the spars 1725, end elements, and heat sink elements. Side spacers 1730 fill the gap between the light bars and side panels.

Figure 18:
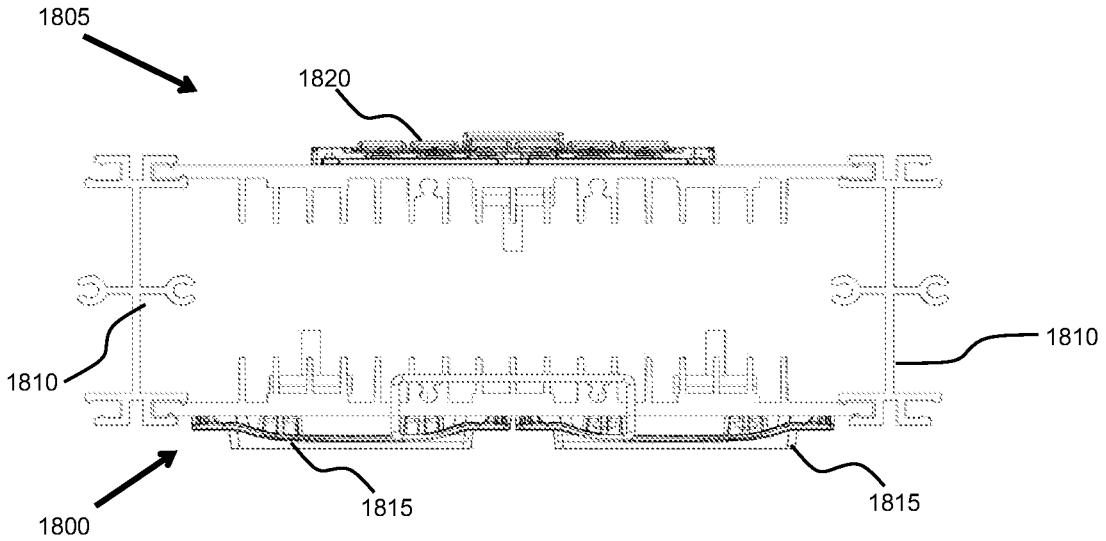
FIG. 18 illustrates a light bar and an uplight installed in two spars in accordance with aspects of the embodiments.

FIG. 18 illustrates a light bar 1800 and an uplight 1805 installed in two spars 1810 in accordance with aspects of the embodiments. This figure clearly illustrates the slot ribs interfacing with the rib grooves such that the spars and heat sink elements are slidably interfaced. The figure further illustrates the light bar lenses 1815 and uplight lens 1820.

Figure 19:
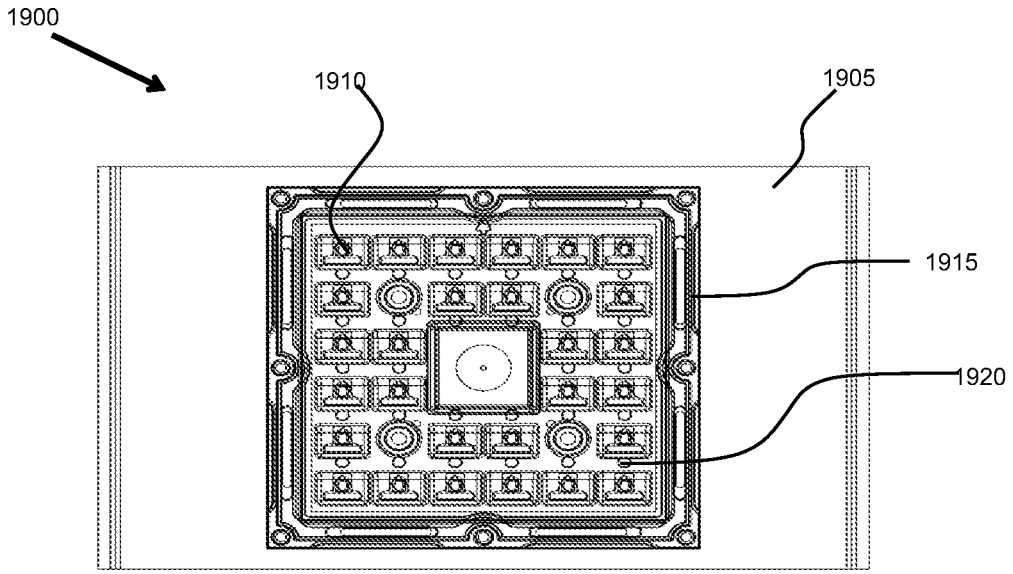
FIG. 19 illustrates a top view of an uplight in accordance with aspects of the embodiments.
Figure 20:
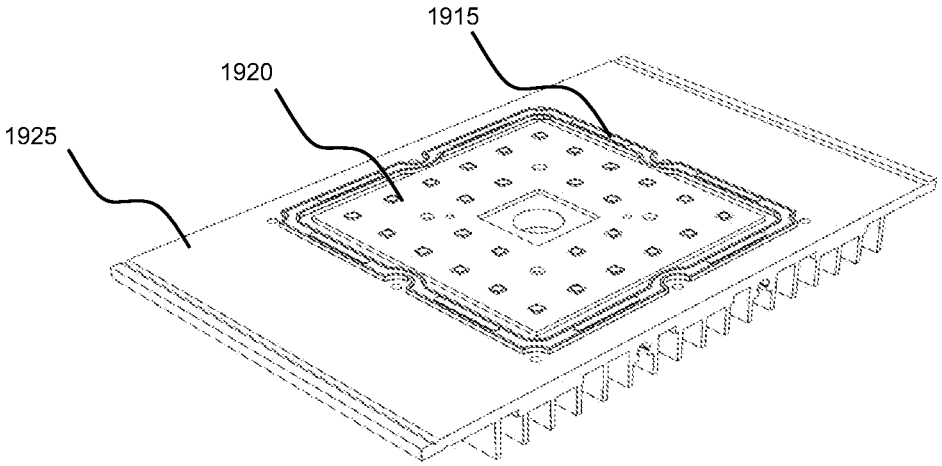
FIG. 20 illustrates an uplight with lens removed viewed from above in accordance with aspects of the embodiments.

FIG. 19 illustrates a top view of an uplight 1900 in accordance with aspects of the embodiments. Being a heat sink element 1905 in combination with an LED assembly, the uplight is quite similar to a light bar, excepting for being about a third the length. The LED array 1920 is sandwiched between the uplight lens 1910 and uplight heat sink 1925. A gasket 1915 creates a seal. Note that the lens is transparent in this figure as well as the light bar figures. Alternative embodiments can have diffusing lenses. FIG. 20 illustrates the uplight of FIG. 19, viewed from above with the lens removed. Note that the lens attachment holes are outside the gasket.

Figure 21:
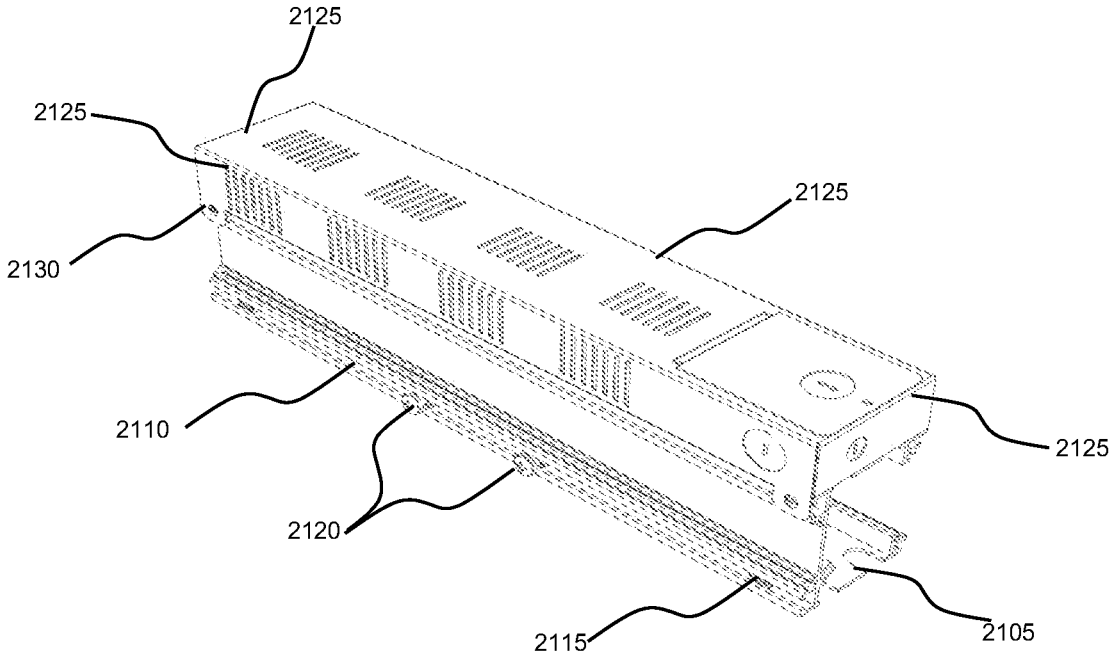
FIG. 21 illustrates a power housing on and end element in accordance with aspects of the embodiments.

FIG. 21 illustrates a power housing on an end element 2105 in accordance with aspects of the embodiments, using holes 2130 for attaching the power housing. The power housing can be attached to the end element with fasteners such as bolts 2115 in the roof T-channel 2110 and a screw 2120 threaded into the bolt. The power housing can be formed from a single sheet of metal by cutting the sheet to shape and adding four ninety degree bends 2125.

Figure 22:
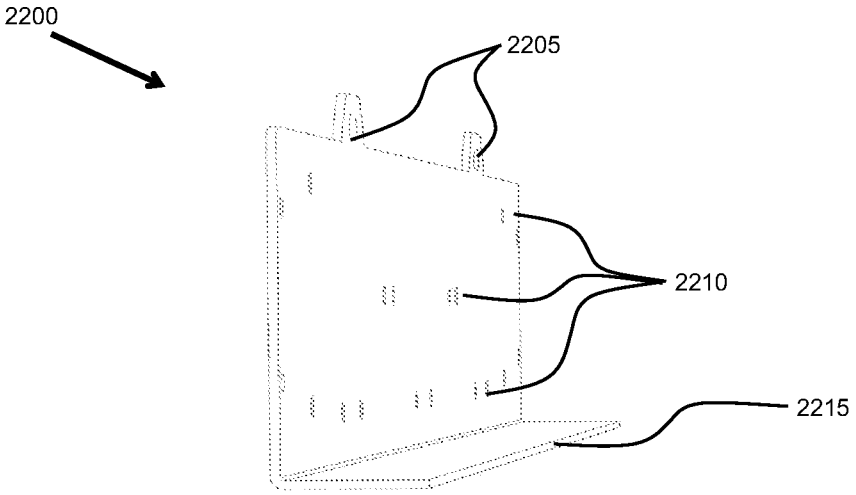
FIG. 22 illustrates a side panel viewed from inside in accordance with aspects of the embodiments.
Figure 23:
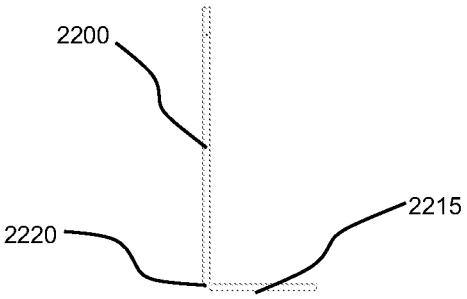
FIG. 23 illustrates an end view of a side panel in accordance with aspects of the embodiments.

FIG. 22 illustrates a side panel 2200 viewed from inside in accordance with aspects of the embodiments. The lighting system can be suspended via the mounting tabs 2205. Screws can pass through the holes 2210 in the sidewall to attach the side pane to spars, end elements, and heat sink elements. A ninety degree bend in the side panel forms the lower tab 2215 which provides rigidity and support. FIG. 23 illustrates an end view of the side panel of FIG. 22, clearly illustrating bend 2220.

It will be appreciated that variations of the above-disclosed and other features and functions, or alternatives thereof, may be desirably combined into many other different systems or applications. It should be understood that certain aspects in the figures may be the same as, or similar to, other aspects. It will also be appreciated that various presently unforeseen or unanticipated alternatives, modifications, variations or improvements therein may be subsequently made by those skilled in the art which are also intended to be encompassed by the following claims.

What is claimed is:

1. A lighting system comprising:
at least one spar;
at least one heat sink element;
at least one LED assembly comprising at least one LED array and at least one lens;
at least one light bar;
two uplight panels, wherein each one of the uplight panels comprises an uplight heat sink and an uplight LED assembly wherein the uplight LED assembly is attached to the uplight heat sink, wherein the uplight heat sink is one of the at least one heat sink elements, and wherein the uplight LED assembly is one the at least one LED assemblies;
a housing comprising a first end, a second end, and two side panels;
a cover covering the top of the housing while leaving clear a lens of the uplight panels; and
a lens frame and a bottom lens, wherein the lens frame holds the bottom lens such that light from the at least one light bar passes through the bottom lens before exiting the lighting system.

2. The lighting system of claim 1 wherein the lens frame is attached to the first end and the second end, and wherein light exiting the at least one LED array passes through the bottom lens before exiting the lighting system.

3. The lighting system of claim 2 further comprising:
two end elements, each comprising an end extrusion profile the end extrusion profile configured such that each end element further comprises a floor T-channel and wherein the lens frame is attached by fasteners in bottom T-channels of the first end and of the second end.

4. The lighting system of claim 3 wherein the side panels are attached by screws threaded into screw grooves of the end elements and into screw engagers of the at least one spar.

5. The lighting system of claim 3 wherein a spar extrusion profile is configured such that each of the at least one spars further comprises a cross comprising an upright and a crossbeam.

6. The lighting system of claim 3 wherein a spar extrusion profile is configured such that each of the at least one spar further comprises a top channel, and a bottom channel.

7. The lighting system of claim 6 wherein a fastener attaches the cover to the top channel of the at least one spar.

8. The lighting system of claim 6 wherein the spar extrusion profile is configured such that each of the at least one spar further comprises a cross comprising an upright and a crossbeam, and wherein screw engagers are positioned on the ends of the cross beams.

9. The lighting system of claim 1 further comprising a second spar that is one of the at least one spars.

10. A lighting system comprising:
at least one spar, each comprising a spar extrusion profile that is the same for all the at least one spar;
two end elements, each comprising an end extrusion profile that is the same for all the end elements;
a plurality of heat sink elements, each comprising a heat sink extrusion profile that is the same for all of the heat sink elements;
a plurality of LED assemblies comprising a plurality of LED arrays, and a plurality of bottom lenses;
a plurality of light bars, wherein each one of the light bars comprises a light bar heat sink and at least one LED array;
at least one uplight panel, wherein each one of the at least one uplight panel comprises an uplight heat sink and an uplight LED assembly wherein the uplight LED assembly is attached to the uplight heat sink;
a housing comprising a first end, a second end, a first spar, and two side panels, wherein the first end and the second end are the two end elements, and wherein the first spar is one of the at least one spars; and
a light engine comprising a first light bar and a second light bar that are two of the plurality of light bars.

11. The lighting system of claim 10 further comprising a power conditioner configured to accept unconditioned electric power and to produce conditioned electric power that powers an LED array.

12. The lighting system of claim 11 wherein the power conditioner is attached to a roof of the first end.

13. The lighting system of claim 12 further comprising a power housing attached to the first end and covering the power conditioner.

14. The lighting system of claim 10 further comprising at least three light bars and a second spar, wherein a third light bar is one of the plurality of light bars, wherein the second spar is one of the at least one spars.

15. The lighting system of claim 10 wherein the spar extrusion profile is configured such that each of the at least one spar further comprises a top channel.

16. The lighting system of claim 15 further comprising a cover wherein a fastener passes through the cover and is threaded into a top groove to thereby fasten the cover to the lighting system.

17. The lighting system of claim 15 further comprising a suspension bracket attached to the first end and to the second end, wherein the suspension bracket does not occlude light exiting the plurality light bars.

18. The lighting system of claim 17 wherein a support bracket is attached to the first end and to the second end by fasteners positioned in the T-channels of the first end and of the second end.

19. The lighting system of claim 10 wherein the heat sink extrusion profile is further configured such that each heat sink element further comprises a screw groove.

20. A lighting system comprising:
a plurality of spars;
two end elements;
a plurality of heat sink elements;

a plurality of LED assemblies, wherein the plurality of LED assemblies are configured to be attached to the plurality of heat sink elements;

at least one light bar, wherein each one of the at least one light bars comprises a light bar heat sink and at least one light bar LED assemblies;

two uplight panels, wherein each one of the two uplight panels comprises an uplight heat sink and an uplight LED assembly wherein the uplight LED assembly is attached to the uplight heat sink, wherein the uplight heat sink is one of the heat sink elements, and wherein the uplight LED assembly is one the LED assemblies;

a housing comprising a first end, a second end, a first spar, a second spar, and two side panels, wherein the first end and the second end are the two end elements, wherein the first spar and the second spar are two of the spars; and a lens frame and a bottom lens wherein the lens frame holds the bottom lens.

* * * * *